US009221290B2

(12) United States Patent
Aoki

(10) Patent No.: US 9,221,290 B2
(45) Date of Patent: Dec. 29, 2015

(54) APPARATUS AND METHOD FOR FORMING AN IMAGE WITH A PLURALITY OF DECOLORIZABLE MATERIALS AND FOR DECOLORIZING THE IMAGE

(71) Applicant: TOSHIBA TEC KABUSHIKI KAISHA, Tokyo (JP)

(72) Inventor: Takayasu Aoki, Shizuoka-ken (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 44 days.

(21) Appl. No.: 14/099,414

(22) Filed: Dec. 6, 2013

(65) Prior Publication Data

US 2015/0160592 A1 Jun. 11, 2015

(51) Int. Cl.

| | |
|---|---|
| ***G03G 15/00*** | (2006.01) |
| ***B41M 7/00*** | (2006.01) |
| ***G03G 15/20*** | (2006.01) |
| ***G03G 21/00*** | (2006.01) |

(52) U.S. Cl.

CPC ..... *B41M 7/0009* (2013.01); *G03G 15/205* (2013.01); *G03G 15/2046* (2013.01); *G03G 15/6585* (2013.01); *G03G 21/00* (2013.01)

(58) Field of Classification Search

CPC G03G 15/36; G03G 15/2078; G03G 15/2039
USPC ..... 399/69, 182
See application file for complete search history.

(56) References Cited

U.S. PATENT DOCUMENTS

| | | | | |
|---|---|---|---|---|
| 8,953,958 | B2 * | 2/2015 | Takahashi | |
| 2011/0292419 | A1 * | 12/2011 | Shibuya | |
| 2012/0275803 | A1 * | 11/2012 | Taguchi et al. | |
| 2012/0282545 | A1 | 11/2012 | Kabai et al. | |
| 2012/0321350 | A1 * | 12/2012 | Ogasawara | |
| 2013/0272739 | A1 * | 10/2013 | Otaki | 399/69 |
| 2014/0192124 | A1 * | 7/2014 | Arima | |
| 2014/0193168 | A1 * | 7/2014 | Kimoto | 399/69 |
| 2014/0212160 | A1 * | 7/2014 | Fukaya | 399/69 |
| 2014/0212192 | A1 * | 7/2014 | Umetsu | |
| 2015/0010317 | A1 * | 1/2015 | Ogasawara | |

FOREIGN PATENT DOCUMENTS

JP 2009-300991 A 12/2009

* cited by examiner

*Primary Examiner* — Susan Lee
(74) *Attorney, Agent, or Firm* — Foley & Lardner LLP

(57) ABSTRACT

An image forming apparatus includes a first image forming unit and a second image forming unit. The first image forming unit is configured to form a first image portion to be transferred to a sheet with a first decolorizable material that is decolorized at a first temperature. The second image forming unit is configured to form a second image portion to be transferred to the sheet with a second decolorizable material that has a color different from the first decolorizable material and that is decolorized at a second temperature that is higher than the first temperature.

18 Claims, 5 Drawing Sheets

APPARATUS AND METHOD FOR FORMING AN IMAGE WITH A PLURALITY OF DECOLORIZABLE MATERIALS AND FOR DECOLORIZING THE IMAGE

FIELD

Embodiments described herein relate generally to an image forming process using a decolorizable recording material, and a decolorizing process of an image formed with the decolorizing recording material.

BACKGROUND

There is an image forming apparatus that forms an image with decolorizable material, which is decolorized by heating. When paper having an image formed with the decolorizable material is subjected to an erasing process, during which heat is applied to the paper by an erasing apparatus, the image is erased. Thus, the paper can be repetitively used for printing. Conventionally, such an erasable image is formed with one type of decolorizable material. Thus, the erasable image can be formed only with the color of the decolorizable material.

DETAILED DESCRIPTION

In general, according to one embodiment, an image forming apparatus includes a first image forming unit and a second image forming unit. The first image forming unit is configured to form a first image portion to be transferred to a sheet with a first decolorizable material that is decolorized at a first temperature. The second image forming unit is configured to forma second image portion to be transferred to the sheet with a second decolorizable material that has a color different from the first decolorizable material and that is decolorized at a second temperature that is higher than the first temperature.

Figure 1:
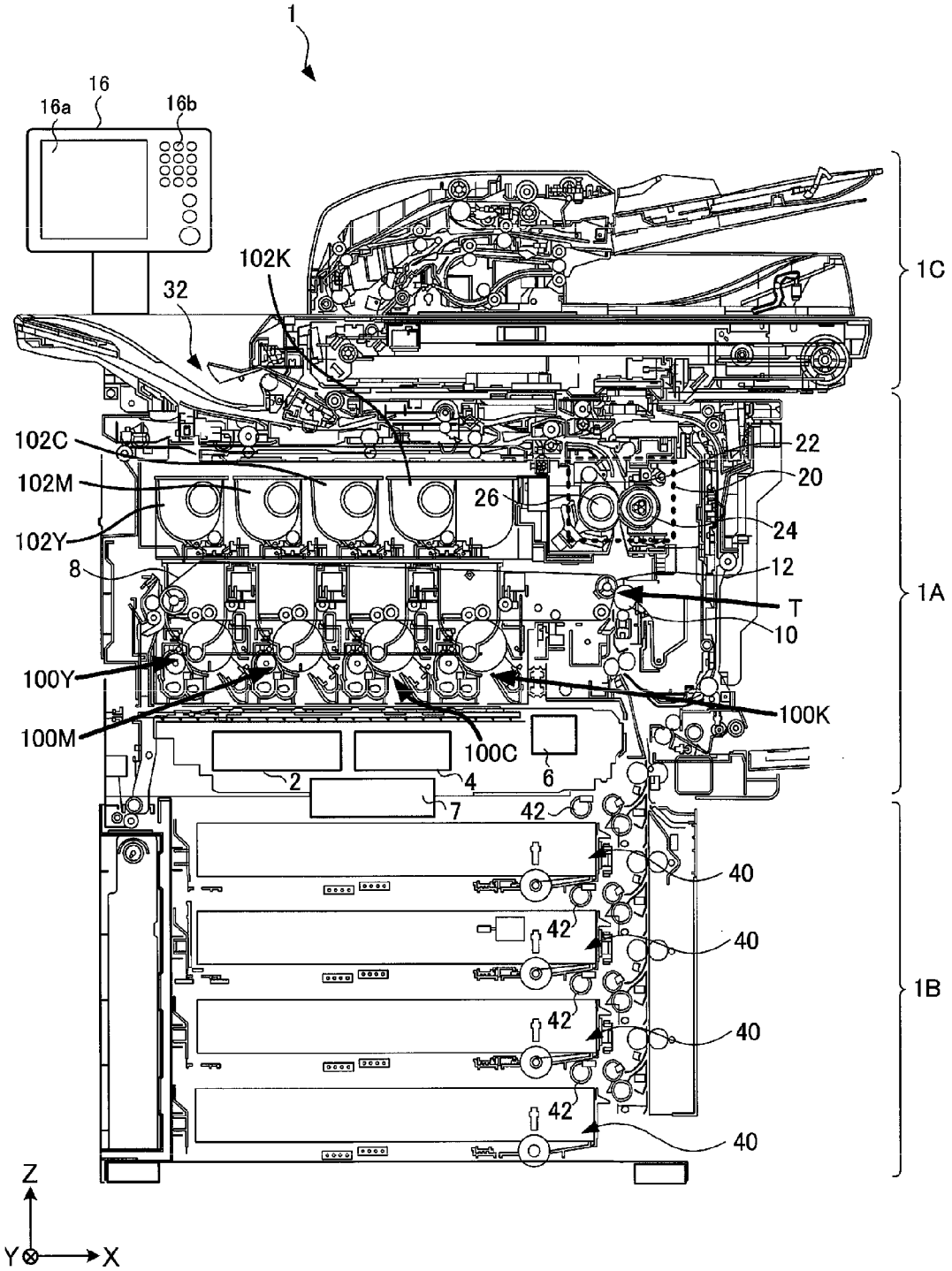
FIG. 1 is a longitudinal sectional diagram schematically showing a configuration of an image forming apparatus according to an embodiment.

First, an image forming apparatus according to an embodiment will be described. FIG. 1 is a longitudinal sectional diagram schematically showing a configuration of the image forming apparatus 1 according to the embodiment. The image forming apparatus of this embodiment is, for example, a multi-functional peripheral (MFP) apparatus having a plurality of functions such as a print function, a copy function of scanning and printing a manuscript, and a scan function.

The image forming apparatus 1 includes a processor 2, a memory 4, an auxiliary storage device 6, an operating panel 16, an image forming portion 1A, a sheet supply portion 1B, an image reading portion 1C, and the like.

The processor 2 is a control device which controls various processes carried out at the image forming portion 1A, the sheet supply portion 1B, and the image reading portion 1C. The processor 2 performs various functions and executes processes by executing programs stored in the memory 4 and the auxiliary storage device 6.

A central processing unit (CPU), a micro-processing unit (MPU) capable of executing the same arithmetic processing as that of the CPU, or the like is used as the processor 2. In addition, an application specific integrated circuit (ASIC) 7 as a processor may perform some or all of the functions of the image forming apparatus 1, which are performed by the processor 2.

The memory 4 is a so-called main storage device which stores programs for enabling the processor 2 to execute processes such as an image forming process in the image forming portion 1A, a sheet supply process in the sheet supply portion 1B, and an image reading process in the image reading portion 1C. The memory 4 provides a temporary working area to the processor 2. For example, a random access memory (RAM), a read only memory (ROM), a dynamic random access memory (DRAM), a static random access memory (SRAM), a video RAM (VRAM), a flash memory, or the like is used as the memory 4.

The auxiliary storage device 6 stores various kinds of information related to the image forming apparatus 1. For example, the auxiliary storage device 6 can store image data generated based on a surface of a sheet read in the image reading portion 1C. For example, a magnetic storage device such as a hard disk drive, an optical storage device, a semiconductor storage device (flash memory or the like), or a combination of the storage devices is used as the auxiliary storage device 6.

The operating panel 16 is a unit to input operational instruction by a user to the image forming apparatus 1, and is also a display portion which displays a setting screen and the like. The operating panel includes a touch display 16*a*, operating keys 16*b*, and the like. The touch display 16*a* displays a screen and the user can perform operational input with the screen. The operating keys 16*b* are physical buttons with which the user can perform various operational inputs.

During printing or copying, the image forming portion 1A performs a process of forming an image on a sheet. The image forming portion 1A forms an image on a sheet such as paper supplied from the sheet supply portion 1B on the basis of print job or copy job. The image forming portion 1A of this embodiment forms an image on paper with a decolorizable recording material which is decolorized by heat. Specifically, the decolorizable recording material is a decolorizable toner which is decolorized by heat. In this embodiment, a decolorizable toner is used as an example of the decolorizable recording material. A decolorizable ink, decolorizable ink ribbon for thermal transfer, or the like may be used as the decolorizable recording material.

The image forming portion 1A has, as processing units, four processing units corresponding to four decolorizable toners having different colors. The decolorizable toners may have any color as long as the colors of the decolorizable toners are different from each other. In this embodiment, the colors are, for example, yellow (Y), magenta (M), cyan (C), and black (K). Accordingly, the four processing units include a yellow processing unit 100Y, a magenta processing unit 100M, a cyan processing unit 100C, and a black processing unit 100K. When YMCK toners are used, the toners can be used to print four single colors, or can also be used for full-color printing by forming an image such that the YMC toners are superimposed on the same image part as in the case of a normal full-color MFP apparatus.

Each of the processing units 100Y to 100K forms a toner image on an intermediate transfer belt 8 with a decolorizable toner of each color. Each processing unit includes a photosensitive drum, a developing machine, primary transfer rolls which are disposed at positions opposed to the photosensitive drum, respectively, with the intermediate transfer belt 8 interposed therebetween, and the like.

In addition, the image forming portion 1A has toner cartridges filled with decolorizable toners of four colors, respectively. The four color toner cartridges correspond to a yellow toner cartridge 102Y, a magenta toner cartridge 102 M, a cyan toner cartridge 102C, and a black toner cartridge 102K, respectively. A toner is supplied from each of the toner cartridges to each of the processing units 100Y to 100K corresponding to the respective toners, and the developing machines of the respective processing units supply the toners to the respective photosensitive drums on which an electrostatic latent image is formed. Toner images of decolorizable toners are primarily transferred from the respective photosensitive drums to the intermediate transfer belt 8, respectively. The decolorizable toners in the toner cartridges of this embodiment have different decolorizing temperatures. The decolorizable toner of this embodiment will be described later in detail.

The image forming portion 1A further includes an intermediate transfer belt 8 as an image carrier, a secondary transfer roller 10 which is a transfer member, a secondary transfer opposing roller 12, a fixing device 20 which is a fixing portion, and the like.

The intermediate transfer belt 8 is an image carrier to which a toner image of decolorizable toner formed on the photosensitive drum corresponding to each color is transferred (primarily transferred) from the photosensitive drum. The intermediate transfer belt 8 transfers the formed toner image to paper at a secondary transfer position T. At the secondary transfer position T, the secondary transfer roller 10 nips the paper with the secondary transfer opposing roller 12 opposed thereto, and transfers the toner image on the intermediate transfer belt 8 to the paper.

The fixing device 20 fixes, to the paper, the developer image transferred to the paper by heating and pressing. The fixing device 20 includes a fixing belt 22, a fixing roller 26, a pressing roller 24, and the like.

The image forming portion 1A is configured as described above. The image forming system of the image forming portion 1A may not be the tandem system shown in the drawing, but be a rotary system.

The sheet supply portion 1B supplies sheets to the image forming portion 1A. The sheet supply portion 1B includes a paper feeding cassette 40, a pickup roller 42, a plurality of pairs of transport rollers which transport sheets toward the secondary transfer position T, and the like. FIG. 1 shows an image forming apparatus including, for example, four paper feeding cassettes 40.

The image reading portion 1C is a device which reads an image on a sheet when performing copying or scanning, and is an image reading device of a copier, an image scanner, or the like.

Next, the decolorizable toner used in the image forming apparatus 1 of this embodiment will be described. The image forming apparatus 1 of this embodiment includes four decolorizable toners in the form of toner cartridges (102Y to 102K). The decolorizable toners are different in terms of temperature at which decolorizing occurs. The decolorizable toner contains an electron-donating coloring agent, an electron-accepting color developing agent, a decolorizing temperature control agent, and a binder resin. The decolorizable toner may further contain a release agent, a reactive polymer, an electrification control agent, an aggregating agent, a surfactant, a pH adjuster, an external additive, and the like.

The electron-donating coloring agent is a precursor compound of a pigment which depicts letters, figures, and the like. A leuco dye can be mainly used as the electron-donating coloring agent. The leuco dye is an electron-donating compound which can develop a color with a color developing agent. Examples of the leuco dye include diphenylmethanephthalides, phenylindolylphthalides, indolylphthalides, diphenylmethaneazaphthalides, phenylindolylazaphthalides, fluorans, styrynoquinolines, and diazarhodamine lactones.

Specific examples of the leuco dye include 3,3-bis(p-dimethylaminophenyl)-6-dimethylamino phthalide, 3-(4-diethylaminophenyl)-3-(1-ethyl-2-methylindole-3-yl)phthalide, 3,3-bis(1-n-butyl-2-methylindole-3-yl)phthalide, 3,3-bis(2-ethoxy-4-diethylaminophenyl)-4-azaphthalide, 3-(2-ethoxy-4-diethylaminophenyl)-3-(1-ethyl-2-methylindole-3-yl)-4-azaphthalide, 3-[2-ethoxy-4-(N-ethylanilino)phenyl]-3-(1-ethyl-2-methylindole-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino) fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino) fluoran, 1,2-benz-6-(N-ethyl-N-isoamylamino)fluoran, 2-(3-methoxy-4-dodecoxystyryl)quinoline, spiro[5H-(1) benzopyrano(2,3-d)pyrimidine-5,1'(3'H)isobenzofuran]-3'-one, 2-(diethylamino)-8-(diethylamino)-4-methyl-, spiro [5H-(1)benzopyrano(2,3-d)pyrimidine-5,1'(3'H) isobenzofuran]-3'-one, 2-(di-n-butylamino)-8-(di-n-butylamino)-4-methyl-, spiro[5H-(1)benzopyrano(2,3-d) pyrimidine-5,1'(3'H)isobenzofuran]-3'-one, 2-di-n-butylamino)-8-(diethylamino)-4-methyl-, spiro[5H-(1) benzopyrano(2,3-d)pyrimidine-5,1'(3'H)isobenzofuran]-3'-one, 2-(di-n-butylamino)-8-(N-ethyl-N-i-amylamino)-4-methyl-, spiro[5H-(1)benzopyrano(2,3-d)pyrimidine-5,1' (3'H)isobenzofuran]-3'-one, 2-(di-n-butylamino)-8-(di-n-butylamino)-4-phenyl, 3-(2-methoxy-4-dimethylaminophenyl)-3-(1-butyl-2-methylindole-3-yl)-4, 5,6,7-tetrachlorophthalide, 3-(2-ethoxy-4-diethylaminophenyl)-3-(1-ethyl-2-methylindole-3-yl)-4,5,6, 7-tetrachlorophthalide, and 3-(2-ethoxy-4-diethylaminophenyl)-3-(1-pentyl-2-methylindole-3-yl)-4,5, 6,7-tetrachlorophthalide. Pyridine, quinazoline, and bisquinazoline compounds may also be included. These may be used as a mixture of two or more.

The electron-accepting color developing agent is a color developing agent which allows the coloring agent to develop color, and is an electron-accepting compound which donates a proton to the leuco dye. Examples of the electron-accepting color developing agent include phenols, phenol metal salts, carboxylic acid metal salts, aromatic carboxylic acids, aliphatic carboxylic acids having 2 to 5 carbon atoms, benzophenones, sulfonic acids, sulfonates, phosphoric acids, phosphoric acid metal salts, acidic phosphoric acid esters, acidic phosphoric acid ester metal salts, phosphorous acids, phosphorous acid metal salts, monophenols, polyphenols, 1,2,3-triazole and derivatives thereof, either unsubstituted or substituted with substituents such as an alkyl group, an aryl group, an acyl group, an alkoxycarbonyl group, a carboxy group and an ester thereof, an amide group, and a halogen group. In addition, bis- and tris-phenols, phenol-aldehyde condensation resins, and metal salts thereof may also be included.

Specific examples of the electron-accepting color developing agent include phenol, o-cresol, tertiary butylcatechol, nonylphenol, n-octylphenol, n-dodecylphenol, n-stearylphenol, p-chlorophenol, p-bromophenol, o-phenylphenol, n-butyl p-hydroxybenzoate, n-octyl p-hydroxybenzoate, benzyl p-hydroxybenzoate, dihydroxybenzoic acids such as 2,3-dihydroxybenzoic acid and methyl 3,5-dihydroxybenzoate and esters thereof, resorcin, gallic acid, dodecyl gallate, ethyl gallate, butyl gallate, propyl gallate, 2,2-bis(4-hydroxyphenyl)propane, 4,4-dihydroxydiphenylsulfone, 1,1-bis(4-hydroxyphenyl)ethane, 2,2-bis(4-hydroxy-3-methylphenyl) propane, bis(4-hydroxyphenyl)sulfide, 1-phenyl-1,1-bis(4-hydroxyphenyflethane, 1,1-bis(4-hydroxyphenyl)-3-methylbutane, 1,1-bis(4-hydroxyphenyl)-2-methylpropane, 1,1-bis(4-hydroxyphenyl)n-hexane, 1,1-bis(4-hydroxyphenyl)n-heptane, 1,1-bis(4-hydroxyphenyl)n-octane, 1,1-bis(4-hydroxyphenyl)n-nonane, 1,1-bis(4-hydroxyphenyl)n-decane, 1,1-bis(4-hydroxyphenyl)n-dodecane, 2,2-bis(4-hydroxyphenyl)butane, 2,2-bis(4-hydroxyphenyl) ethylpropionate, 2,2-bis(4-hydroxyphenyl)-4-methylpentane, 2,2-bis(4-hydroxyphenyl) hexafluoropropane, 2,2-bis(4-hydroxyphenyl)n-heptane, 2,2-bis(4-hydroxyphenyl)n-nonane, 2,4-dihydroxyacetophenone, 2,5-dihydroxyacetophenone, 2,6-dihydroxyacetophenone, 3,5-dihydroxyacetophenone, 2,3,4-trihydroxyacetophenone, 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, 2,3,4,4'-tetrahydroxybenzophenone, 2,4'-biphenol, 4,4'-biphenol, 4-[(4-hydroxyphenyl)methyl]-1,2,3-benzenetriol, 4-[(3,5-dimethyl-4-hydroxyphenyl)methyl]-1,2,3-benzenetriol, 4,6-bis[(3,5-dimethyl-4-hydroxyphenyl) methyl]-1,2,3-benzenetriol, 4,4'-[1,4-phenylenebis(1-methylethylidene)bis(benzene-1,2,3-triol)], 4,4'-[1,4-phenylenebis(1-methylethylidene)bis(1,2-benzenediol)], 4,4',4"-ethylidenetrisphenol, 4,4'-(1-methylethylidene) bisphenol, and methylenetris-p-cresol. These may be used as a mixture of two or more.

The decolorizing temperature control agent used herein controls a decolorizing temperature. The decolorizing temperature control agent may decolorize color by inhibiting a color developing reaction between the leuco dye as a coloring agent and the color developing agent under heat in the three-component system of the coloring agent (coloring compound), the color developing agent, and the color erasing temperature control agent.

The four decolorizable toners are different in terms of temperature at which decolorizing occurs. The decolorizing temperature can be controlled by changing the type of the decolorizing temperature control agent contained in the decolorizable toner. In order to cause decolorizing, it is necessary to heat an image formed on paper with the decolorizable toner to a temperature equal to higher than the decolorizing temperature of the decolorizable toner. Therefore, in order to cause decolorizing color by color by changing the decolorizing temperatures with regard to the respective colors such that, for example, a magenta toner image is left, but a yellow image is erased, it is preferable to set a difference between the decolorizing temperatures of the respective color toners to such an extent that an erasing device can more reliably adjust temperature of an erasing unit. Specifically, the difference between the decolorizing temperatures is preferably 5° C. or higher, and more preferably 15° C. or higher.

Including the decolorizing temperature control agent is particularly preferable, because the color developing-decolorizing mechanism, based on temperature hysteresis, of the decolorizing temperature control agent leads to excellent instantaneous erasability. It is possible to cause decolorizing when heating the color-developed mixture of the three-component system to a specific decolorizing temperature Th or higher. Furthermore, even when the decolorized mixture is cooled to a temperature equal to or lower than Th (approximately room temperature), the decolorized state is maintained. When the temperature is further lowered, a reversible color developing-decolorizing reaction can be caused, in which the color developing reaction between the leuco dye and the color developing agent is restored at a temperature equal to or lower than a specific color restoring temperature Tc to return to the color-developed state. Particularly, the decolorizing temperature control agent used herein preferably satisfies a relation of Th>Tr>Tc, where Tr represents a room temperature.

Preferable examples of the decolorizing temperature control agent capable of causing the temperature hysteresis include alcohols, esters, ketones, ethers, and acid amides. Particularly, esters are more preferable. Specific examples of the esters include carboxylic acid esters that contain a substituted aromatic ring, esters of unsubstituted aromatic ring-containing carboxylic acid and aliphatic alcohol, carboxylic acid esters that contain a cyclohexyl group in the molecule, esters of fatty acid and unsubstituted aromatic alcohol or phenol, esters of fatty acid and branched aliphatic alcohol, esters of dicarboxylic acid and aromatic alcohol or branched aliphatic alcohol, dibenzyl cinnamate, heptyl stearate, didecyl adipate, dilauryl adipate, dimyristyl adipate, dicetyl adipate, distearyl adipate, trilaurin, trimyristin, tristearin, dimyristin, and distearin. These may be used as a mixture of two or more.

The binder resin is melted in the fixing process and fixes, to the paper, the coloring agent which is a color material and the color developing agent. A polyester resin which is obtained by subjecting a dicarboxylic acid component and a diol component to polycondensation through an esterification reaction is preferable as the binder resin. When a styrene resin is used as the binder resin, fixing needs a higher temperature because the glass transition temperature of the styrene resin is generally higher than that of the polyester resin. Examples of the acid component include aromatic dicarboxylic acids such as terephthalic acid, phthalic acid, and isophthalic acid, and aliphatic carboxylic acids such as fumaric acid, maleic acid, succinic acid, adipic acid, sebacic acid, glutaric acid, pimelic acid, oxalic acid, malonic acid, citraconic acid, and itaconic acid.

Examples of the alcohol component (diol component) include aliphatic diols such as ethylene glycol, propylene glycol, 1,4-butanediol, 1,3-butanediol, 1,5-pentanediol, 1,6-hexanediol, neopentyl glycol, trimethylene glycol, trimethylolpropane and pentaerythritol, alicyclic diols such as 1,4-cyclohexanediol and 1,4-cyclohexanedimethanol, and ethylene oxide or propylene oxide adducts of bisphenol A or the like.

As the binder resin, the polyester component may be converted to have a crosslinked structure using a tri- or higher-valent carboxylic acid component such as 1,2,4-benzenetricarboxylic acid (trimellitic acid) and glycerin or a polyhydric alcohol component. Two or more types of polyester resins having different compositions may be mixed and used.

The polyester resin which is the binder resin may be amorphous or crystalline. The glass transition temperature of the polyester resin is preferably 45° C. to 70° C., and more preferably 50° C. to 65° C. It is not preferable that the glass transition temperature be lower than 35° C., because the heat-resistant storage stability of the toner deteriorates and the gloss of the resin is prominent upon erasing. It is preferable that the glass transition temperature be lower than 70° C., because the low-temperature fixability deteriorates and the erasability upon heating is poor.

The release agent improves releasability from the fixing member when the toner is fixed to paper by heating or pressing. Examples of the release agent include aliphatic hydrocarbon waxes such as low-molecular weight polyethylene, low-molecular weight polypropylene, polyolefin copolymers, polyolefin wax, paraffin wax, and Fischer Tropsch wax and modified products thereof, vegetable waxes such as candelilla wax, carnauba wax, Japan wax, jojoba wax, and rice wax, animal waxes such as beeswax, lanolin, and spermaceti, mineral waxes such as montan wax, ozokerite, and ceresine, fatty acid amides such as linolenic acid amide, oleic acid amide, lauric acid amide, functional synthetic waxes, and silicone waxes.

Here, it is particularly preferable that the release agent have an ester bond of components including an alcohol component and a carboxylic acid component. Examples of the alcohol component include higher alcohols, and examples of the carboxylic acid component include saturated fatty acids having a linear alkyl group, unsaturated fatty acids such as monoenoic acid and polyenic acid, and hydroxy fatty acids. As an unsaturated polycarboxylic acid, maleic acid, fumaric acid, citraconic acid, itaconic acid, or the like can be exemplified. Anhydrides thereof may be exemplified. The softening point of the release agent is preferably approximately 50° C. to 120° C., and more preferably 60° C. to 110° C. from the viewpoint of low-temperature fixability.

The reactive polymer is, for example, a polymer capable of crosslinking the binder resin. Examples of the reactive polymer include reactive polymers having an oxazoline group. The reactive polymer is preferably water-soluble in order to manufacture the decolorizable toner of this embodiment in an aqueous system. Examples of preferable commercialized products thereof include "EPOCROS WS-500" and "EPOCROS WS-700", manufactured by Nippon Shokubai Co., Ltd.

As other reactive polymers, there are compounds having an epoxy group, and examples of commercialized products thereof include DENACOL EX313, 314, 421, 512, and 521, manufactured by Nagase ChemteX Corporation. These compounds having an epoxy group may be used alone when the binder resin is a resin having a carboxyl group (oxidized polyester or polystyrene resin). A substance having an amino group or a hydroxyl group may be added as the reactive polymer.

Using a crosslinking agent of such a reactive polymer, color material fine particles can be completely incorporated in the toner, and thus the image density during printing is improved and image defects such as fogging are improved.

By including the electrification control agent, a frictional electrification charge amount can be adjusted. A metal-containing azo compound can be used as the electrification control agent, and a complex, complex salt, or a mixture of iron, cobalt and chrome is preferable as a metal element. In addition, the electrification control agent may be a metal-containing salicylic acid derivative compound. A complex, complex salt, or a mixture of zirconium, zinc, chrome, and boron is preferable as a metal element of the metal-containing salicylic acid derivative compound.

In this embodiment, an aggregating agent may be used as necessary. The aggregating agent is not particularly limited, and a monovalent metal salt such as sodium chloride, a polyvalent metal salt such as magnesium sulfate or aluminum sulfate, a non-metal salt such as ammonium chloride or ammonium sulfate, an acid such as hydrochloric acid or nitric acid, or a strong cationic coagulant (aggregating agent) based on polyamine or polyDADMAC may be appropriately used as the aggregating agent.

In this embodiment, a surfactant may be used as necessary. The surfactant is not particularly limited, and, for example, an anionic surfactant based on sulfuric ester salt, sulfonate, phosphoric acid ester, or fatty acid salt, a cationic surfactant based on amine salt or quarternary ammonium salt, an ampholytic surfactant based on betaine, a nonionic surfactant based on polyethylene glycol, alkylphenol ethylene oxide adduct, or polyhydric alcohol, or a polymeric surfactant based on polycarboxylic acid can be appropriately used as the surfactant. In general, the surfactant is added for the purpose of imparting dispersion stability such as stability of aggregated particles when a toner is manufactured. However, a reverse-polarity surfactant or the like may be used as the aggregating agent.

In this embodiment, a pH adjuster for adjusting the pH in the system may be used as necessary. The pH adjuster is not particularly limited. For example, as an alkali, a basic compound such as sodium hydroxide, potassium hydroxide, or an amine compound, and as an acid, an acidic compound such as hydrochloric acid, nitric acid, or sulfuric acid can be appropriately used.

In this embodiment, inorganic fine particles as an external additive may be mixed with the toner in an amount of 0.01 wt % to 20 wt % with respect to toner particles in order to adjust fluidity and electrification properties. As the inorganic fine particles which are used as an external additive, silica, titania, alumina, strontium titanate, tin oxide, and the like can be used alone or as a mixture of two or more. It is preferable to use inorganic fine particles surface-treated with a hydrophobizing agent from the viewpoint of an improvement in environmental stability. Other than such an inorganic oxide, resin particles having a diameter of 1 μm or less may be added as an external additive for improving cleanability.

The color developing mechanism of the decolorizable toner containing the above components has a characteristic that the coloring agent based on a leuco dye represented by crystal violet lactone (CVL) develops a color when the color developing agent represented by a phenolic compound is combined, and is decolorized when being dissociated therefrom. When a substance, called the decolorizing temperature control agent, having a large temperature difference between a melting point and a solidifying point is used as well as the color developing agent and the color erasing agent, a color material which is decolorized when being heated to a temperature equal to or higher than the melting point of the decolorizing temperature control agent and in which the color-erased state is maintained even at room temperature when the solidifying point is equal to or lower than the room temperature is obtained. It is possible to use a color-developable and decolorizable color material system in which the leuco coloring agent, the color developing agent, and the decolorizing temperature control agent are encapsulated.

In general, in order to fix the toner, the fixing temperature of the decolorizable toner is required to be higher than a glass transition temperature Tg of the binder resin and be at least adjacent to a softening temperature Tm. In addition, in the present system, the fixing temperature is required to be equal to or lower than the decolorizing temperature Th in order not to erase the color during fixing.

In addition, the electron-donating coloring agent, the electron-accepting color developing agent, and the decolorizing temperature control agent of the decolorizable toner are preferably microencapsulated as the color material. The foregoing materials are rarely affected by external environment through the microencapsulation, and thus it is possible to more accurately control the color developing and the decolorizing.

Next, a method of manufacturing the toner used in this embodiment will be described. Regarding the decolorizable toner of this embodiment, particulates of a toner component are preferably manufactured by a so-called chemical manufacturing method and aggregated by an aggregating method to have a particle diameter required for the toner. In general, it is preferable that the toner be manufactured by a method other than a kneading method, because decolorizing occurs during kneading at the kneading temperature, which is generally higher than the decolorizing temperature of the color material.

In the chemical manufacturing method, after aggregation of toner particles, a fusion process is performed to smooth a surface of a toner particle and to increase a toner circularity. In general, the fusion temperature is equal to or higher than the glass transition temperature Tg of the resin. Accordingly, when the decolorizing temperature of the color material is lower than the fusion temperature, decolorizing occurs during the fusion process. Accordingly, the decolorizing temperature of the color material is preferably higher than the fusion temperature.

An example of a flow of a method of manufacturing the decolorizable toner will be described. First, a color material containing a coloring agent, a color developing agent, and a decolorizing temperature control agent is melted by heating. The color material is microencapsulated using a urethane resin through a coacervation method. Next, the microencapsulated color material, a binder resin dispersion liquid in which a binder resin is dispersed, and a release agent dispersion liquid in which a release agent is dispersed are aggregated and fused using an aggregating agent (for example, aluminum sulfate ($Al_2(SO_4)_3$)). The resulting material is washed and dried to obtain a toner.

The decolorizable toner of each color is manufactured using different types of decolorizing temperature control agents in order that the decolorizing temperature varies for each color.

For microencapsulation of the color material, a method using an isocyanate polyol wall material, a method using a urea-formaldehyde or urea-formaldehyde-resorcinol-based wall forming material, or a method using a wall forming material such as a melamine-formaldehyde resin or hydroxypropyl cellulose is used. The method for encapsulation is not limited to an interfacial polymerization and a coacervation method, and a method by polymer precipitation, an in-situ method by monomer polymerization, an electrolysis-dispersion-cooling method, a spray drying method, and the like may also be used.

The configuration of the image forming apparatus 1 and the configuration of the decolorizable toner used in the image forming apparatus 1 of this embodiment are as described above. The image forming apparatus 1 may have two or more color toners having different decolorizing temperatures.

[Image Forming Method]

Next, an image forming method in the image forming apparatus 1 will be described. As described above, the plurality of types of decolorizable toners used in the image forming apparatus 1 have different decolorizing temperatures. Therefore, for example, a letter string or a figure which will not be decolorized as far as possible may be formed with a decolorizable toner having a higher decolorizing temperature, and a letter string or a figure which will be or may be decolorized may be formed with a decolorizable toner having a lower decolorizing temperature. In addition, for example, a fixed part such as a frame for printing letter strings of a document may be printed with a decolorizable toner having a lower decolorizing temperature, and substantial letter strings and the like of the document may be formed with a decolorizable toner having a higher decolorizing temperature.

Regarding which part of an image to be formed is printed with which decolorizable toner, a client terminal which prepares a document may have a designation function of designating a decolorizable toner to be used in a document preparation software, a printer driver or the like to include decolorizable toner designation information in the print job. The image forming apparatus 1 can form an image with a corresponding decolorizable toner on the basis of the decolorizable toner designation information.

In the image forming apparatus 1 having a plurality of types of decolorizable toners having different decolorizing temperatures, when an image is formed only one color, it is preferable to form the image with decolorizable toner having the lowest decolorizing temperature. Using the decolorizable toner having the lowest decolorizing temperature, the temperature at an erasing unit of an erasing device can be lowered and energy can thus be saved.

[Erasing Method]

Next, an erasing process for paper on which an image is formed with decolorizable toners having different decolorizing temperatures by the image forming apparatus 1 according to this embodiment will be described. An erasing device (erasing unit) which performs the erasing process may be an image forming apparatus which has an erasing function and in which the fixing device 20 of the image forming apparatus 1 of FIG. 1 can also serve as an erasing device, or an erasing device which is dedicated to perform the erasing process and has an erasing unit which applies heat to paper as an erasing target. In any case, the setting temperature of the erasing process of the erasing device can be preferably set in stages in accordance with the decolorizing temperature of the decolorizable toner of each color, or preferably set to an arbitrary temperature.

Figure 2:
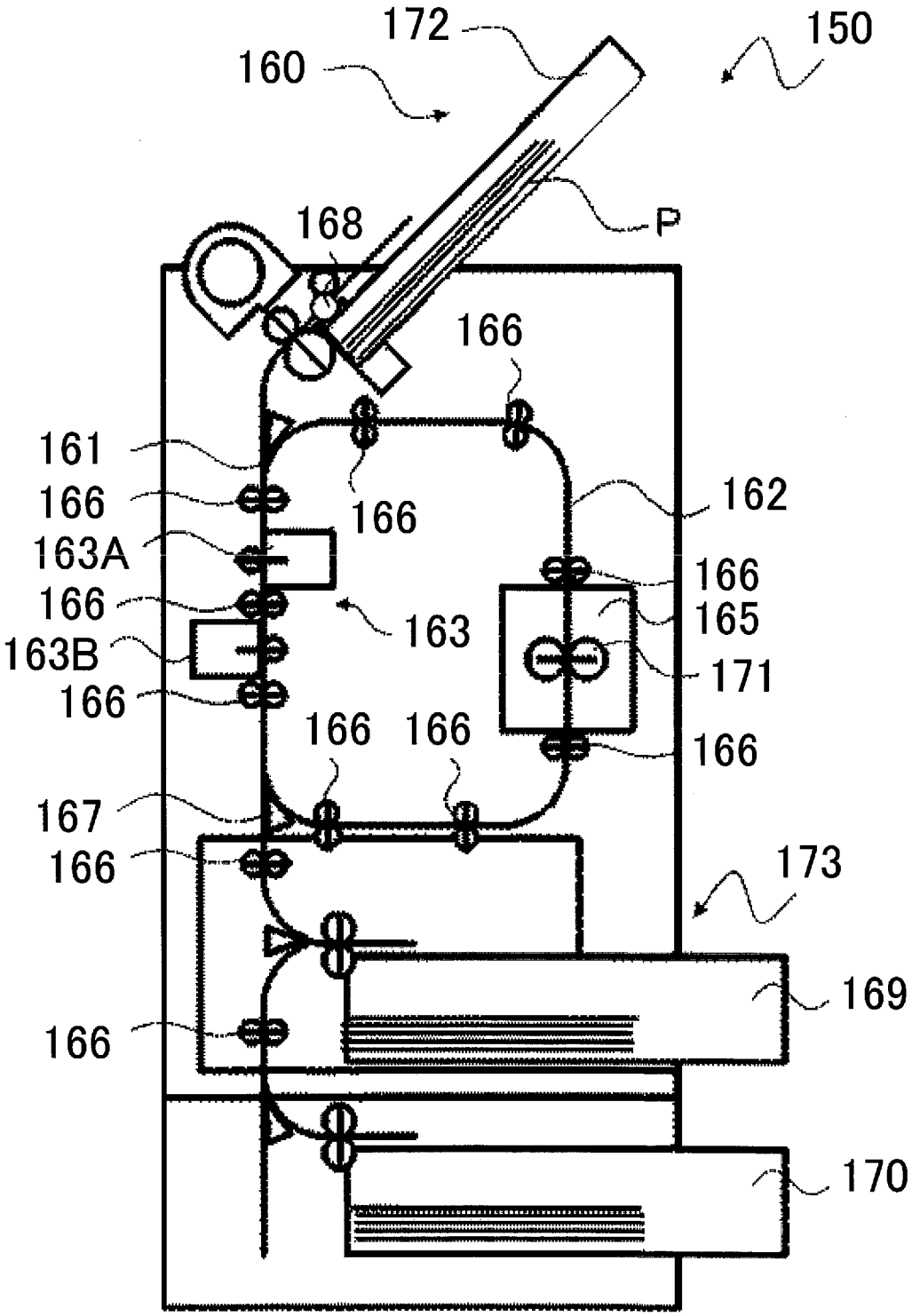
FIG. 2 is a diagram showing a configuration of an erasing device which is an example of the embodiment.

Here, the erasing device will be described. FIG. 2 is a diagram showing a configuration of an erasing device 150. The erasing device 150 erases an image on paper (recording medium) formed by the image forming apparatus and enables reuse of the paper. The color erasing device 150 has a paper feeding unit 160, a first transport path 161, a second transport path 162, a first reading unit 163A, a second reading unit 163B, a color erasing unit 165, a transport roller 166, a path change unit (switching unit) 167, a first paper discharge unit 169, and a second paper discharge unit 170.

In order to erase an image on paper P to be reused, the paper feeding unit 160 feeds the paper into the erasing device 150. The paper feeding unit 160 has a paper feeding tray 172 and a pickup roller 168. On the paper feeding tray 172, sheets of paper P which will be reused are stacked. The pickup roller 168 takes paper P out of the paper feeding tray 172 one by one and sends the paper P towards the first transport path 161.

Along the first transport path 161 and the second transport path 162, a plurality of transport rollers 166 are disposed, and each of the transport rollers 166 includes a pair of a driving roller and a driven roller. Along the first transport path 161, a pair of a first reading unit 163A and a second reading unit 163B is disposed. Each of the first reading unit 163A and the second reading unit 163B has a two-dimensional CCD scanner. The first reading unit 163A reads one surface of the paper transported from the paper feeding unit 160, and the second reading unit 163B reads a surface opposite to the surface read by the first reading unit 163A. The image data read out by the first reading unit 163A and the second reading unit 163B is stored in a random access memory (RAM) 203 which is a storing unit shown in the block diagram of FIG. 3. The destination of the image data read out by the first reading unit 163A and the second reading unit 163B is not limited to the RAM 203, but may be a read only memory (ROM) 202, a hard disk drive (HDD), or a memory.

The image data read out by the first reading unit 163A and the second reading unit 163B may be stored not only in the RAM 203 of the color erasing device 150, but also in a RAM 302 of a client PC 151 connected to the erasing device 150 via a network 153 or a RAM 402 of a server 152. In addition, when the erasing device 150 has a login-logout function to individually identify a user, the image data stored in the RAM 203 of the erasing device 150 may be transmitted to and stored in the RAM 302 of the client PC 151 or the RAM 402 of the server 152 upon logout from the erasing device 150.

In addition, the first reading unit 163A and the second reading unit 163B read the surfaces of the paper to determine whether the paper P can be used and whether the images printed on the paper was erased.

The reading by the first reading unit 163A and the second reading unit 163B is performed second times. The first reading unit 163A and the second reading unit 163B digitize and store the read-out image data in the storing unit through first reading. The first reading unit 163A and the second reading unit 163B perform second reading after erasing to determine whether the paper can be reused after the erasing process.

Through first reading, in addition to storing of the image data whether reuse is not permitted due to wrinkle, staple, folding, memo that has not been erased, and the like may be determined. In this case, when it is determined that the paper may be reusable through first reading, the erasing process is performed, and then whether the image on the paper P has been erased is determined through second reading. The paper is then discharged to the first paper discharge unit 169 or the second paper discharge unit 170. When it is determined that the paper is non-reusable through first reading, the erasing process is performed, and the paper is discharged to the first paper discharge unit 169 or the second paper discharge unit 170 without the second reading being performed. In addition, when it is determined that the paper is non-reusable through first reading, the paper may be discharged to the first paper discharge unit 169 or the second paper discharge unit 170 without the color erasing process and the second reading being performed. These settings can be selected and set in advance. The first reading unit 163A and the second reading unit 163B are not limited to the pair of two-dimensional CCD scanners, and may be a CMOS sensor.

In addition, whether reuse is not permitted due to wrinkle, staple, folding, non-erasable memo, and the like may be determined through reading after the erasing. The reading after the erasing may be the first reading or the second reading. When the reading is performed after the erasing, the wrinkle, staple, folding, non-erasable memo, and the like are easily detected. A CPU 200 determines whether the paper is non-reusable due to wrinkle, staple, folding, non-erasable-memo, and the like by reading after the erasing, and discharges the paper to the first paper discharge unit 169 or the second paper discharge unit 170 in accordance with the determination result. These settings can be selected and set in advance.

The first transport path 161 is connected to the first paper discharge unit 169 or the second paper discharge unit 170 from the paper feeding unit 160. The second transport path 162 branches off from a division point located downstream with respect to the first reading unit 163A and the second reading unit 163B along the first transport path 161, and joins together at a junction point located upstream with respect to the first reading unit 163A and the second reading unit 163B along the first transport path 161. The path change unit 167 is disposed at the division point.

The second transport path 162 has the erasing unit 165 in the middle of the transport path. The erasing unit 165 has a pair of rollers 171 and a heater 205. The pair of rollers 171 is heated by the heater 205. By heating the paper P to a predetermined temperature or higher through the pair of rollers 171 heated by the heater 205, the image on the paper P formed with a decolorizable image forming material is heated and the color material is decolorized. The erasing unit 165 can erase the images on both sides of the paper P by performing the erasing of an image by the pair of rollers 171.

The paper discharge unit 173 has the first paper discharge unit 169 and the second paper discharge unit 170. The paper P subject to the various processes is discharged to the first paper discharge unit 169 or the second paper discharge unit 170. A user may select the first paper discharge unit 169 or the second paper discharge unit 170 to discharge the paper P to the selected unit.

Figure 3:
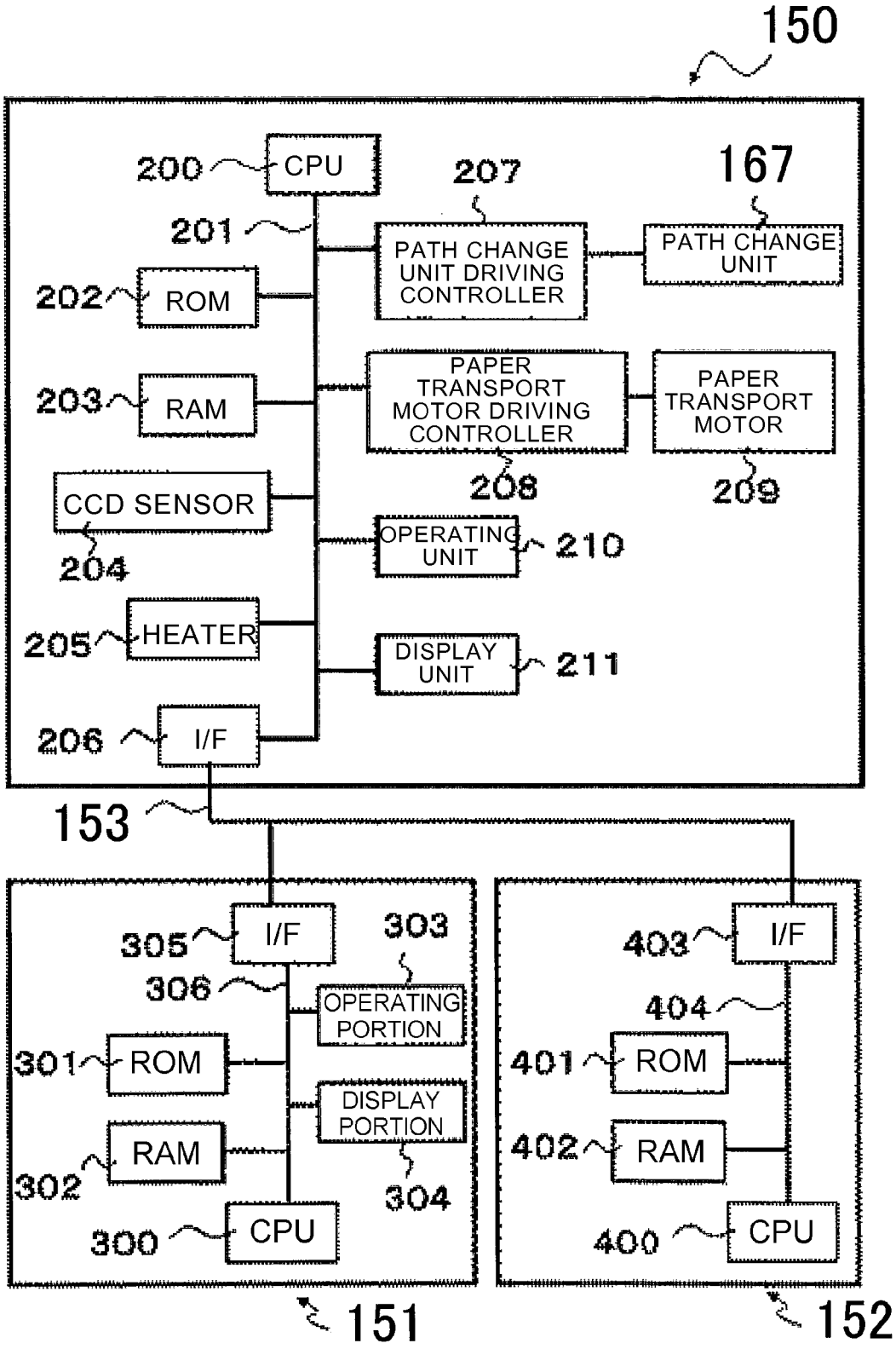
FIG. 3 is a block diagram of the erasing device and the like shown in FIG. 2.

FIG. 3 is a block diagram of the erasing device 150, the client PC 151, and the server 152. The read only memory (ROM) 202, the RAM 203, CCD sensors 204 of the first reading unit 163A and the second reading unit 163B, the heater 205 of the erasing unit 165, and an interface (I/F) 206 which inputs data from the outside and outputs data to the outside are connected to the central processing unit (CPU) 200 which is a controller of the erasing device 150 through a system bus 201. The CPU 200 communicates with the client PC 151 and the server 152 by the I/F 206 connected through the system bus 201.

A path change unit driving controller 207 which controls the path change unit 167, a paper transport motor driving controller 208 which controls a paper transport motor 209 which drives the transport roller, an operating unit 210, and a display unit 211 are connected to the CPU 200.

The ROM 202 stores programs for operating the CPU 200, a paper printing rate for guiding whether reuse is permitted, and a density threshold for determining whether the image has been erased. A density threshold which is used to determine a wrinkle depth and the like when determining the wrinkle depth and the like through first image reading is also stored. The RAM 203 stores an image which is obtained when reading the image on the paper P. The CCD sensor 204 is disposed as an array of line sensors and detects a gradation of the paper P. The heater 205 uses an IH heater or the like to decolorize the color material by applying heat to the paper P through the pair of rollers 171 during the passage of the paper P through the erasing unit 165.

The operating unit 210 has, for example, a touch panel-type display unit 211 and various operating keys, and is disposed in an upper part of the main body of the erasing apparatus. The operating keys include, for example, a numeric key, a stop key, a start key, and the like. The display unit 211 displays setting information including various processing modes of the erasing device 150, an operation status, log information, or a message to a user. The user can select a processing mode of the erasing device 150 such as start of erasing or reading of the image on the sheet P to be erased through the operating unit 210. The processing mode will be described later. The operating unit 210 is not limited to one disposed in the main body of the erasing device 150. For example, a configuration may also be employed in which an operating unit of an external apparatus connected to the erasing device 150 can perform operation through a network. Otherwise, the operating unit 210 may be configured to be separated from the main body of the erasing device and to operate the erasing device 150 by wired or wireless communication. The operating unit of this embodiment may issue a processing instruction to the erasing device 150 or access information.

The CPU 200 controls the path change unit driving controller 207 to drive the path change unit 167, thereby distributing and transporting the paper P from the first transport path 161 to the second transport path 162, or distributing and transporting the paper P from the first transport path 161 to the first paper discharge unit 169 or the second paper discharge unit 170. Furthermore, after erasing of the image, the CPU 200 determines whether the color was decolorized in a normal manner, that is, whether the paper P is reusable.

As described above, the erasing device 150 can set the setting temperature of the erasing process which is performed by the erasing unit 165, in stages in accordance with the decolorizing temperature of the decolorizable toner of each color, or set the setting temperature to an arbitrary temperature.

Figure 4:
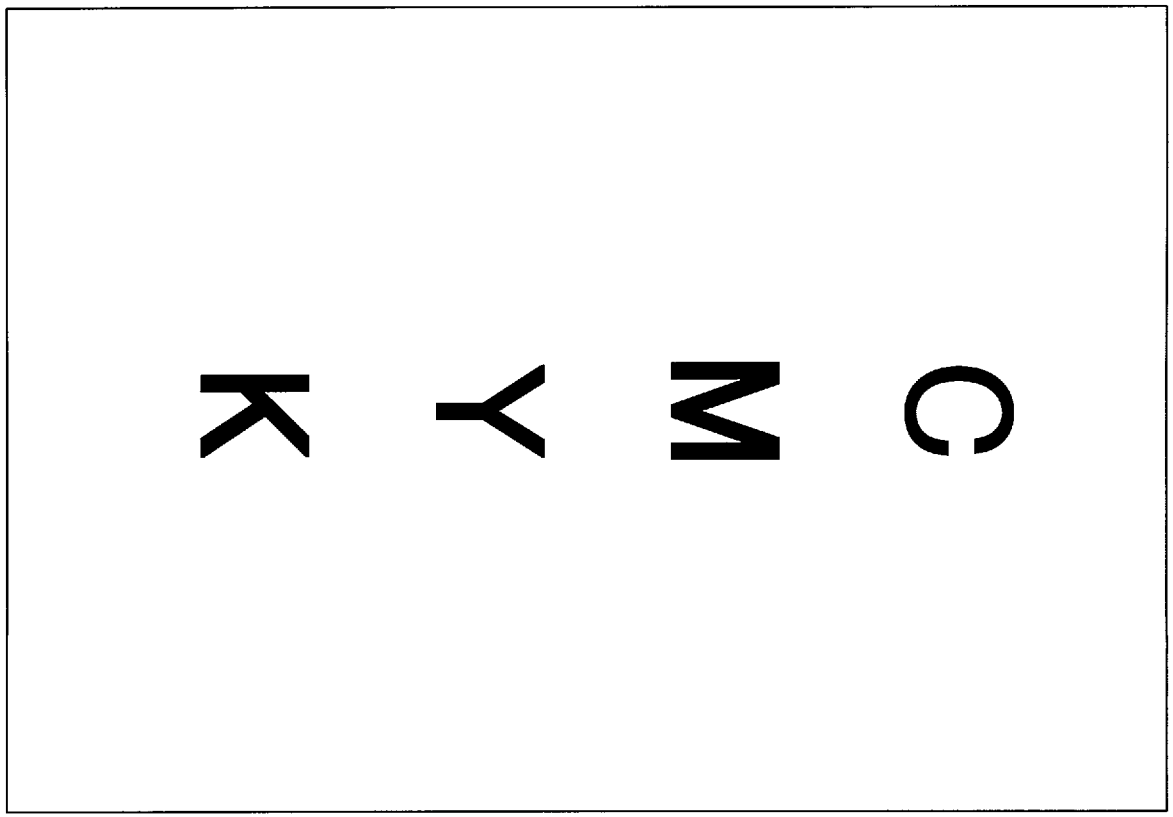
FIG. 4 is an example of an image formed on paper by the image forming apparatus according to the embodiment.

Next, regarding the erasing process of this embodiment, an exemplary case in which paper on which an image is formed as shown in FIG. 4 by the image forming apparatus 1 is erased will be described. A letter string of CMYK is formed as an image as shown in FIG. 4. C is formed with decolorizable toner having a cyan color, M is formed with decolorizable toner having a magenta color, Y is formed with decolorizable toner having a yellow color, and K is formed with decolorizable toner having a black color.

In addition, for example, a relation of $Th(K)<Th(Y)<Th(C)<Th(M)$ is satisfied, where Th(C) represents a decolorizing temperature of the decolorizable toner having a cyan color, Th(M) represents a decolorizing temperature of the decolorizable toner having a magenta color, Th(Y) represents a decolorizing temperature of the decolorizable toner having a yellow color, and Th(K) represents a decolorizing temperature of the decolorizable toner having a black color. The fixing temperature of each decolorizable toner is lower than the lowest decolorizing temperature (Th(K) in the case of the above relationship).

In this case, for example, when a setting temperature Te of the erasing device is set to satisfy $Th(K)<Te<Th(Y)$ to thus perform the erasing process, the decolorizable toner having a black color is decolorized, and thus only K is erased among CMYK printed on the paper. When the setting temperature Te is set to satisfy $Th(C)<Te<Th(M)$, the decolorizable toners having a black color, a yellow color, and a cyan color, respectively, are decolorized, and thus C, Y, and K are erased and only M remains. When Te is higher than Th(M), all of the letters are erased.

The erasing method of this embodiment is as described above. The above-described erasing device 150 can perform this erasing process in the same manner, whereby the erasing unit 165 of the erasing device 150 can perform the erasing process under the above-described processing conditions to erase only an image formed with a specific decolorizable toner in an image formed with a plurality of decolorizable toners.

As described above, when the image formed on paper is formed with a plurality of decolorizable toners, only an image formed with a specific type of decolorizable toner can be erased by setting the setting temperature of the erasing device in accordance with the decolorizing temperature of the decolorizable toner.

Modified Examples of Embodiments

Figure 5:
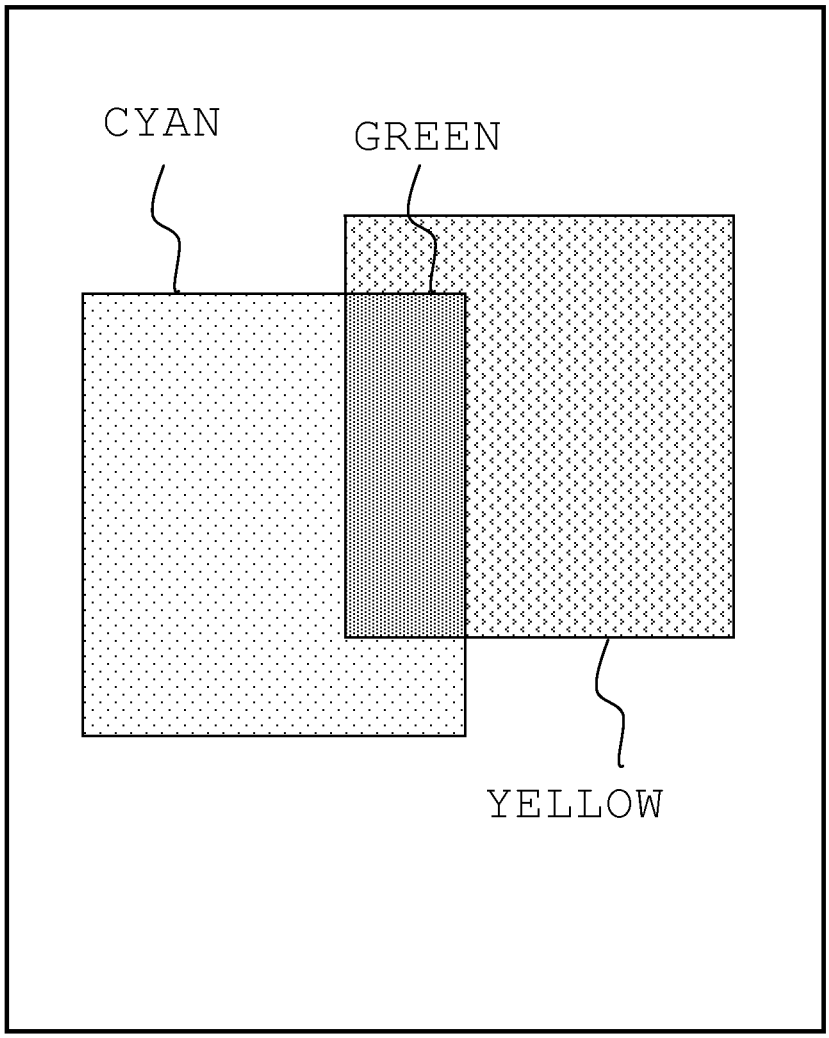
FIG. 5 is an example of an image formed with two types of toner, a part of which the two types of toner overlap with each other.

Modified examples of the image forming process carried out by the image forming apparatus 1 according to this embodiment and the erasing process carried out by the erasing device will be described. In this embodiment, the image forming apparatus 1 forms a toner image by superimposing decolorizable toners of at least two colors on the same image part as that of an image formed on paper as shown in FIG. 5, and fixes the toner image to the paper. When an image is formed by superimposing decolorizable toners of two or more colors, the image can be formed with various colors in the same manner as in the case of a normal color image forming apparatus. For example, when the above-described decolorizable toner having a cyan color and decolorizable toner having a yellow color are superimposed at a predetermined ratio to form an image in the same part of the same image, a green image can be formed.

When the erasing device heats paper, on which an image is formed by superimposing decolorizable toners on the same image (part) as described above, to such a temperature that a decolorizable toner of at least one color is decolorized and another decolorizable toner of at least one color is not decolorized and remains, thereby performing the erasing process, color change from a color formed by superimposing the plurality of decolorizable toners to a color formed with the toner which is not decolorized and remains is possible. For example, a green image is formed by superimposing a cyan toner and a yellow toner as in the above-described example. In the case in which a relation of $Th(Y)<Th(C)$ is satisfied between the decolorizing temperature Th(C) of cyan and the decolorizing temperature Th(Y) of yellow, when the setting temperature Te is set to satisfy $Th(Y)<Te<Th(C)$ to thus perform the erasing process, the image color can be changed from green to cyan.

In this manner, when an image is formed by superimposing a plurality of toners having different decolorizing temperatures, color change from a first color formed through the superimposition to a second color obtained by decolorizing at least one color toner is possible.

Examples

Next, examples will be described in detail. First, manufacturing examples of respective color materials of four color toners will be shown.

(Manufacturing of Color Material C of Cyan)

Components including 1 part of 3-(2-ethoxy-4-diethylaminophenyl)-3-(1-ethyl-2-methylindole-3-yl)-4-azaphthalide as a leuco dye as a coloring agent of a color material C, 5.0 parts of 2,2-bis(4'-hydroxyphenyl)hexafluoropropane as a color developing agent, and 50 parts of diester of 1,10-decanedicarboxylic acid and 2-(4-benzyloxyphenyl)ethanol as a decolorizing temperature control agent were uniformly dissolved by heating and were mixed with 20 parts of an aromatic polyvalent isocyanate prepolymer and 40 parts of ethyl acetate as encapsulating agents to obtain a solution. The solution was emulsified and dispersed in 300 parts of an aqueous solution of 8% polyvinyl alcohol. Stirring of the resulting dispersion was continued for 1 hour at 90° C. Then, 2.5 parts of water-soluble aliphatic modified amine as a reaction agent was added thereto and the stirring was further continued for 6 hours to obtain encapsulated particles. The median particle diameter in volume was 3 μm. The color was blue. The decolorizing temperature Th was 82° C. and the effective solid content concentration was 70%.

(Manufacturing of Color Material M of Magenta)

A color material M was manufactured in the same manner as in the case of the color material C, except that 2-(dibutylamino)-8-(dipentylamino)-4-methyl-spiro[5H-[1]benzopyrano[2,3-g]pyrimidine-5,1'(3'H)-isobenzofuran]-3-one was used as a leuco dye as a coloring agent of the color material M, 2,2-bis(4'-hydroxyphenyl)hexafluoropropane was used as a color developing agent, and diester of suberic acid and 2-(4-benzyloxyphenyl)ethanol was used as a decolorizing temperature control agent. The color was pink. The decolorizing temperature Th was 90.5° C. and the effective solid content concentration was 70%.

(Manufacturing of Color Material Y of Yellow)

A color material Y was manufactured in the same manner as in the case of the color material C, except that 4-[2,6-bis(2-ethoxyphenyl)-4-pyridyl]-N,N-dimethylbenzeneamine was used as a leuco dye as a coloring agent of the color material Y, 2,2-bis(4'-hydroxyphenyl)hexafluoropropane was used as a color developing agent, and diester of pimelic acid and 2-(4-benzyloxyphenyl)ethanol was used as a decolorizing temperature control agent. The color was yellow. The decolorizing temperature Th was 74.5° C.

(Manufacturing of Color Material K of Black)

A color material K was manufactured in the same manner as in the case of the color material C, except that 2-(2-chloroamino)-6-dibutylaminofluorane was used as a leuco dye as a coloring agent of the color material K, 2,2-bis(4'-hydroxyphenyl)hexafluoropropane was used as a color developing agent, and diester of 1,18-octadecane dicarboxylic acid and 2-(4-2-methylbenzyloxy)phenyl))ethanol was used as a decolorizing temperature control agent. The color was black. The decolorizing temperature Th was 62.5° C. and the effective solid content concentration was 70%.

(Manufacturing of Amorphous Polyester Resin A)

53.1 parts by weight of polyoxypropylene(2.2)-2,2-bis(4-hydroxyphenyl)propane, 21.1 parts by weight of polyoxyethylene(2.0)-2,2-bis(4-hydroxyphenyl)propane, 22.6 parts by weight of fumaric acid, 3.2 parts by weight of adipic acid, 0.1 parts by weight of tert-butylcatechol, and 0.5 parts by weight of tin octylate were put and the temperature was increased to 210° C. under a nitrogen atmosphere to react the foregoing components at 210° C. Then, a condensation reaction was caused until a desired softening point was reached at 8.3 KPa under reduced pressure, thereby obtaining an amorphous polyester resin A to be used as a binder resin.

(Manufacturing of Release Agent Dispersion Liquid A)

480 g of deionized water and 4.3 g of an aqueous solution of dipotassium alkenylsuccinate (trade name: LATEMUL ASK, manufactured by Kao Corporation, effective concentration: 28 wt %) were put into a 1 L beaker, and 120 g of carnauba wax was dispersed therein. While kept at 90° C. to 95° C., the resulting dispersion liquid was processed using an ultrasonic homogenizer US-600T (manufactured by Nihonseiki Kaisha Ltd.) for 30 minutes so as to be dispersed. After cooling, deionized water was added thereto to adjust the solid content to 20 wt %, whereby a release agent dispersion liquid was obtained. The median particle diameter in volume of the obtained release agent dispersion liquid was 0.42 μm. The effective solid content concentration was 40%.

(Manufacturing of Resin Dispersion Liquid A)

600 g of an amorphous polyester resin A, 40 g of sodium dodecylbenzenesulfonate (solid content: 15 wt %) as an anionic surfactant "Neopelex G-15 (manufactured by Kao Corporation)", 6 g of polyoxyethylene (26 mol) oleyl ether as a nonionic surfactant "Emulgen 430 (manufactured by Kao Corporation)" and 218 g of an aqueous solution of 5 wt % potassium hydroxide were dispersed at 25° C. in a 5 L stainless-steel pot under stirring at 200 r/min, and then the temperature was increased to 90° C. The resulting content was stabilized at 90° C. and kept for 2 hours under stirring. Next, 1076 g of deionized water was added dropwise at 6 g/min, and thus an emulsion was obtained. The emulsion was cooled and then passed through a metal mesh, whereby a toner binder resin dispersion liquid A was obtained. The median particle diameter in volume of fine resin particles in the obtained toner binder resin dispersion liquid A was 0.16 μm, and the solid content concentration was 32 wt %.

(Manufacturing Example of Cyan Toner C)

28 g of a color material A and 290 g of deionized water were added to sufficiently disperse the color material in the water. 45 g of a release agent dispersion liquid A was added thereto, and then 200 g of a resin dispersion liquid A and 200 g of deionized water were added thereto. The resulting material was fed in a quantitative manner over 7 hours. The temperature was 45° C. 100 g of an aqueous solution of ammonium sulfate (concentration: 30%) was added as an aggregating agent during the process. Thereafter, 2.5 g of Epocros WS-700 as a crosslinking agent manufactured by Nippon Shokubai Co., Ltd., 2.7 g of Emal E-27C as a dispersant manufactured by Kao Corporation, and 80 g of deionized water were fed, and the temperature was increased to 65° C. The resulting material was left for fusion of a toner for 2 hours. The median particle diameter in volume was 10.5 μm. Thereafter, the toner was washed with pure water and then dried until the water content was 1 wt % or less. Thereafter, 3.0 wt % of NAX50 ($SiO_2$) and 0.3 wt % of NKT90 ($TiO_2$) manufactured by Nippon Aerosil K.K. were externally added with respect to 100 wt % of the toner.

(Manufacturing Example of Magenta Toner M)

A toner M was prepared in the same manner as in the case of the toner C, except that the color material C of the cyan toner C was changed to the color material M.

(Manufacturing Example of Yellow Toner Y)

A toner Y was prepared in the same manner as in the case of the toner C, except that the color material C of the cyan toner C was changed to the color material Y.

(Manufacturing Example of Black Toner K)

A toner K was prepared in the same manner as in the case of the toner C, except that the color material C of the cyan toner C was changed to the color material K.

(Preparation of Developer)

Four color developers were prepared by mixing the obtained toners C to K with a ferrite carrier coated with a silicone resin or the like, respectively.

(Example of Image Forming Process)

Developers having the toner C, the toner M, the toner Y, and the toner K, respectively, were set in the quadruple tandem image forming apparatus of FIG. 1. A type in which a fixing temperature could be changed was used as the fixing device of FIG. 1. Accordingly, the image forming apparatus was an apparatus which could also be used as an erasing device (erasing unit) when the temperature of the fixing device was set to a temperature equal to or higher than the decolorizing temperature of the toner, and thus also serving as both of the fixing device and the erasing device. A color mode was set to perform printing with all of the color toners. The temperature of the fixing device was set to 60° C. to form an image by fixing the toners at a relatively low temperature, that is, 60° C. ppc paper (P-50s) manufactured by Toshiba Corporation was used as paper.

Next, an erasing process was performed employing a decolorizing function. First, a setting temperature (erasing temperature) of the erasing process was set to 100° C. to erase the above printed matter, and thus all of the color images were erased. Next, the erasing temperature was set to 85° C. to erase the above printed matter, and thus only magenta remained in the color-developed state and other three colors were decolorized. Next, the erasing temperature was set to 79° C. to erase the above printed matter, and thus cyan and magenta remained in the color-developed state and the remaining two colors were erased. Next, the erasing temperature was set to 70° C. to erase the above printed matter, and thus cyan, magenta, and yellow remained in the color-developed state and the remaining black was erased.

As shown from the foregoing examples, when an image is formed with decolorizable toners having different decolorizing temperatures, an image having a specific color can be erased and an image having another specific color can remain in a color-developed state in accordance with the setting temperature of the erasing process. Various combinations of colors to be decolorized and colors which will remain in a color-developed state can be set by changing a combination of the toner (leuco dye+color developing agent) and the decolorizing temperature control agent.

As described above in detail, according to the technique described herein, an image can be formed with a plurality of colors using decolorizable recording materials, and a erasing process in which only a specific color is decolorized and another specific color remains in the color-developed state can be performed.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising: a first image forming unit configured to form a first image portion to be transferred to a sheet with a first decolorizable material that is decolorized at a first temperature; and a second image forming unit configured to form a second image portion to be transferred to the sheet with a second decolorizable material that has a color different from the first decolorizable material and that is decolorized at a second temperature that is higher than the first temperature; wherein at least a part of the first image portion overlaps with the second image portion on the sheet, and a portion of an image at which the first image portion overlaps with the second image portion has a color different from the color of the first decolorizable material and the color of the second decolorizable material.

2. The image forming apparatus according to claim 1, further comprising: a controller configured to control the first image forming unit to form the first image portion and the second image forming unit to form the second image portion, wherein, when an image is monochrome, the controller controls the first image forming unit to form the entire image as the first image portion.

3. The image forming apparatus according to claim 1, further comprising: a heating unit configured to fix the first and second image portions onto the sheet by heating the first and second image portions to a temperature that is lower than the first temperature.

4. The image forming apparatus according to claim 3, wherein the heating unit is configured to erase the fixed first image portion and not erase the fixed second image portion by heating the fixed first image portion to a temperature that is higher than the first temperature and lower than the second temperature.

5. The image forming apparatus according to claim 3, wherein the heating unit is configured to erase both the fixed first image portion and the fixed second image portions by heating the fixed first image portion and the fixed second image portion to a temperature that is higher than the second temperature.

6. The image forming apparatus according to claim 1, wherein a difference between the second temperature and the first temperature is equal to or greater than five degrees centigrade.

7. The image forming apparatus according to claim 1, wherein both the first and second decolorizable materials include an electron-donating coloring agent, an electron-accepting color developing agent, and a decolorizing temperature control agent.

8. The image forming apparatus according to claim 7, wherein the electron-donating coloring agent, the electron-accepting color developing agent, and the decolorizing temperature control agent of the first decolorizable material are encapsulated, and the electron-donating coloring agent, the electron-accepting color developing agent, and the decolorizing temperature control agent of the second decolorizable material are encapsulated.

9. A method for forming an image on a sheet, comprising: forming a first image portion to be transferred to a sheet with a first decolorizable material that is decolorized at a first temperature; and forming a second image portion to be transferred to the sheet with a second decolorizable material that has a color different from the first decolorizable material and that is decolorized at a second temperature that is higher than the first temperature; wherein at least a part of the first image portion overlaps with the second image portion on the sheet, and a portion of an image at which the first image portion overlaps with the second image portion has a color different from the color of the first decolorizable material and the color of the second decolorizable material.

10. The method according to claim 9, further comprising: fixing the first and the second image portions by heating the first and second image portions to a temperature that is lower than the first temperature.

11. The method according to claim 10, further comprising: erasing the fixed first image portion, not erasing the fixed second image portion, by heating the fixed first image portion to a temperature that is higher than the first temperature and lower than the second temperature.

12. The method according to claim 10, further comprising: erasing both the fixed first image portion and the fixed second image portion by heating the fixed first image portion and the fixed second image portion to a temperature that is higher than the second temperature.

13. The method according to claim 9, wherein a difference between the second temperature and the first temperature is equal to or greater than five degrees centigrade.

14. The method according to claim 9, wherein both the first and second decolorizable materials include an electron-donating coloring agent, an electron-accepting color developing agent, and a decolorizing temperature control agent.

15. The method according to claim 14, wherein the electron-donating coloring agent, the electron-accepting color developing agent, and the decolorizing temperature control agent of the first decolorizable material are encapsulated, and the electron-donating coloring agent, the electron-accepting color developing agent, and the decolorizing temperature control agent of the second decolorizable material are encapsulated.

16. A method for erasing at least a portion of an image formed on a sheet, the method comprising: applying heat to the image including a first image portion formed with a first decolorizable material that is decolorized at a first temperature and a second image portion formed with a second decolorizable material that has a color different from the first decolorizable material and that is decolorized at a second temperature that is higher than the first temperature; and heating the image to a temperature that is higher than the first temperature and lower than the second temperature, thereby erasing the first image portion but not the second image portion.

17. The method according to claim 16, further comprising: heating the second image portion to a temperature that is higher than the second temperature, thereby erasing the second image portion.

18. The method according to claim 16, wherein a difference between the second temperature and the first temperature is equal to or greater than five degrees centigrade.

* * * * *